United States Patent [19]

Stahlmann et al.

[11] 4,142,467

[45] Mar. 6, 1979

[54] PROJECTILE WITH SABOT

[75] Inventors: Rudolf Stahlmann; Uwe Brede, both of Fürth; Axel Homburg, Bensberg, all of Fed. Rep. of Germany

[73] Assignee: Dynamit Nobel Aktiengesellschaft, Fed. Rep. of Germany

[21] Appl. No.: 813,432

[22] Filed: Jul. 7, 1977

[30] Foreign Application Priority Data

Jul. 9, 1976 [DE] Fed. Rep. of Germany ..... 2630830

[51] Int. Cl.[2] ..... F42B 13/16

[52] U.S. Cl. ..... 102/93; 102/92.4; 102/92.7

[58] Field of Search ..... 102/93, 92.7, 92.6, 102/92.4, 92.1

[56] References Cited

U.S. PATENT DOCUMENTS

| | | | |
|---|---|---|---|
| 3,446,147 | 5/1969 | Engel et al. | 102/93 |
| 3,496,869 | 2/1970 | Engel | 102/93 |
| 3,724,377 | 4/1973 | Birkigt | 102/93 |
| 3,747,533 | 7/1973 | Rossmann | 102/93 |
| 3,771,458 | 11/1973 | Schweimler et al. | 102/93 |
| 3,905,299 | 9/1975 | Feldmann | 102/93 |
| 3,927,618 | 12/1975 | Engel | 102/93 |
| 3,948,184 | 4/1976 | Pierre et al. | 102/93 |
| 3,949,677 | 4/1976 | Voss | 102/92.1 |
| 3,951,071 | 4/1976 | Germerhausen | 102/93 |

FOREIGN PATENT DOCUMENTS

| | | | |
|---|---|---|---|
| 1900604 | 10/1969 | Fed. Rep. of Germany | 102/92.4 |
| 2007822 | 9/1970 | Fed. Rep. of Germany | 102/92.4 |

*Primary Examiner*—Charles T. Jordan
*Attorney, Agent, or Firm*—Craig & Antonelli

[57] ABSTRACT

A sabot projectile including a sabot, a subcaliber projectile and a hood arranged in front of the sabot and surrounding at least a part of the projectile. The hood is coupled to the sabot and/or the projectile and is separable therefrom. The sabot is provided with at least one bore extending in the longitudinal direction and arranged for exposure to propellant gases upon firing of the sabot projectile from the barrel of a weapon and for directing the propellant gases onto the hood for accelerating the hood relative to the projectile while the sabot projectile is within the barrel of the weapon.

35 Claims, 14 Drawing Figures

PROJECTILE WITH SABOT

Figure 1A:
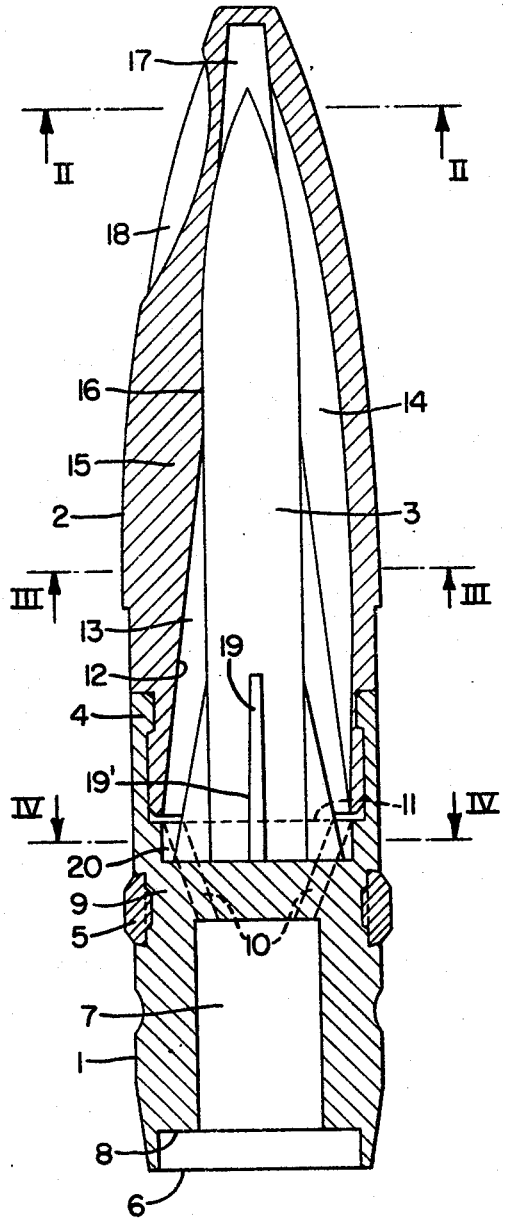

The present invention relates to a sabot projectile of the type having a subcaliber projectile and a sabot provided with a continuous bore extending in the longitudinal direction which can be exposed to propellant gases, and a hood or cap arranged in front of the sabot for surrounding the projectile along at least a portion of its length and being separable upon elimination of the connection to the sabot and/or to the projectile.

It is customary in projectiles provided with a sabot to arrange the subcaliber projectile between a rearward sabot and a forward hood, cap, jacket, or the like, which are of caliber size, in order to optimize the feeding of the cartridge to the firearm and the acceleration of the projectile within the barrel. The connection between the hood and the sabot and/or the subcaliber projectile must be fashioned, on the one hand, so that it can withstand the mechanical stesses up to the point of firing, especially the high, shock-like stresses during introduction into automatic guns having a high firing rate, i.e., so that the sabot projectile is not prematurely disintegrated or damaged. On the other hand, this connection must permit, after firing, the intentional disintegration of the sabot projectile, i.e., the throwing off of the hood and subsequently thereto the separation of the sabot from the subcaliber projectile, so that the subcaliber projectile alone continues its flight to the target.

In accordance with DOS (German Unexamined Laid-Open Application) 2,007,822, the sabot and the hood are joined by screws, and the subcaliber projectile is fixed with respect to both the sabot and hood by additional, longitudinal or axial locking elements. Further, special radial locking elements may optionally be provided enabling, for the purpose of spin transmission, the establishment of a rotationally fixed connection between the sabot and the subcaliber projectile. The effect of the additional locking elements is overcome during firing, for example due to centrifugal forces. The hood, made of a synthetic resin and provided with external, longitudinal grooves, is destroyed upon firing after exiting from the barrel.

In another projectile with sabot, disclosed in DOS No. 2,336,904, an additional metallic sleeve is provided connecting the hood indirectly with the sabot. The hood is likewise disintegrated after leaving the barrel due to centrifugal force and/or aerodynamic pressure, and thereafter the sabot is separated from the subcaliber projectile by the oncoming flow of air. The sabot has a coaxial, continuous bore passing over into a central blind bore of the subcaliber projectile. This makes it possible, for example, to ignite during firing a flare charge arranged within the blind bore directly by means of the propellant gases.

A disadvantage inherent in these sabot projectiles is that the separation of the hood takes place by centrifugal force and/or the aerodynamic pressure, so that the strength of the connection between the hood and the sabot and/or the subcaliber projectile must not exceed a limit determined by these forces. However, it would be more advantageous to be able to construct this connection with a higher strength so as to be able to securely withstand the stresses during transport, handling, and loading of the cartridges even under very unfavorable conditions, for example under very low ambient temperatures. Moreover, the construction of these sabot projectiles becomes undesirably expensive due to the provision of additional locking elements.

It is therefore an object of the present invention to overcome, in particular, the aforementioned disadvantages in a projectile with sabot of the type having a subcaliber projectile and a sabot provided with a continuous bore extending in the longitudinal direction which can be exposed to propellant gases, and a hood or cap arranged in front of the sabot for surrounding the projectile along at least a portion of its length and being separable upon elimination of the connection to the sabot and/or to the projectile.

It is another object of the present invention to construct the sabot projectile of the aforementioned type with a maximally high strength connection between the hood and the sabot and/or the projectile so the structure of the sabot projectile remains simple and its flawless functioning is reliably ensured even under unfavorable conditions.

In accordance with the present invention, a sabot projectile of the aforementioned type is provided with at least one bore or recess for enabling the propellant gases to be effective on the hood for accelerating the hood relative to the projectile while in the barrel of the firearm. By this feature, namely to enable separation of the hood from the remainder of the sabot projectile while within the barrel of the firearm on account of the pressure of the propellant gases, it is advantageously possible to substantially increase the separating force and accordingly to provide a greater strength of the connection between the hood and the sabot and/or the subcaliber projectile. Preferably, the hood is joined to the sabot by a form-fitting connection in the manner of a snap connection. However, it is also possible instead to provide a bayonet catch, or a threaded, cemented, or welded connection, or, for example, also a plug-in connection with a corresponding firm press-fit. Additional locking elements are thus not required, so that the sabot projectile of this invention has a very simple structure.

For the separation by gas pressure according to the present invention, the hood is connected and/or connectible, with its rearward surface facing the sabot, by way of at least one continuous communicating bore extending in the longitudinal direction of the sabot with the rearward surface of the hood, which can be exposed to the propellant gases. Under the pressure effect of the propellant gases, the hood is accelerated relative to the projectile and thereby separated from the projectile and from the sabot. The connection between the rearward surface of the sabot and the rearward surface of the hood need not initially exist, but rather can also be established only upon the instant of firing, for example by the rupturing of a bursting diaphragm, which seals the bore of the sabot, under the action of the propellant gases. The propellant gases can be effective directly on the hood, but they can also act on the hood in an indirect manner, for example by way of an intermediate element provided for other reasons. In the latter case, the intermediate element or the like is then accelerated together with the hood relative to the remaining body of the sabot projectile. The mass of the hood optionally also the mass of other components to be subjected to the relative acceleration, is smaller than the mass of the remaining body of the sabot projectile.

In accordance with the present invention, the hood is already separated while passing through the barrel of the gun. The instant and/or site of separation is dependent, inter alia, on the mass difference between the hood and the other parts of the sabot projectile which "are left behind"; on the amount of gas pressure acting on the hood; on the size of the cross-sectional area of the hood directly or indirectly exposed to the propellant gases; and on the strength of the connection between the hood and the sabot and/or the projectile. The separation takes place at a later time, the smaller the mass difference, for example in a preferred tripartite structure between the sabot and the projectile, on the one hand, and the hood, on the other hand. A reduction in the gas pressure and in the cross-sectional area, as well as an increase in the strength of the connection have analogous effects. Accordingly, the location where the separation takes place within the barrel of the gun can be determined in accordance with the requirements in each individual case. In general, a maximally late separation is preferred, i.e., a separation close to the mouth of the barrel, so that the hood while passing through the barrel centers the subcaliber projectile practically up to the barrel mouth. The separation of the hood, however, can also take place at an earlier point in time and thus at a greater distance before the barrel mouth, if it is possible, for example, to achieve the desired centering of the projectile while passing through the barrel by means of the gaseous envelope formed by the propellant gases which, after separation of the hood, flow laterally past the subcaliber projectile.

The hood is conventionally manufactured preferably of a synthetic resin, such as, for example, polyethylene or polyamide. However, the hood can also be made of other materials, such as, for example, an aluminum alloy or also of wood, which materials prevent, on the one hand, any damage to the sabot projectile during feeding and, on the other hand, ensure a flawless separation within the barrel. Preferably, the hood is fashioned so that it is not destroyed under the action of the propellant gases. Insofar as no impairment of the trajectory of the projectile is to be feared, it is also possible, however, to provide, for example, that the hood is broken up into more or less large fragments during separation or thereafter by the effect of the propellant gases.

The rearward surface of the hood, on which the propellant gases are effective, can be fashioned, for instance, as a planar, ring-shaped surface surrounding the subcaliber projectile, this surface being only a small distance from the sabot, so that the propellant gases exiting from the at least one bore of the sabot act on the hood, so to speak, without delay, since there is practically no additional space to be filled by the propellant gases. To avoid as far as possible any undesired peak values in the stress on the hood during the movement of the sabot projectile within the barrel, a feature of the present invention provides that the hood is equipped with at least one hollow space emanating from the rear end thereof and into which the propellant gases cam enter via the bore of the sabot. This hollow space acts as a compensating chamber for the gas pressure and attenuates the shock-like stress on the hood and thus also on the subcaliber projectile.

In accordance with another feature of the present invention, the gas pressure chamber of the hood is advantageously constructed as an annular space, and the hood is provided with a guiding portion which contacts and centers the projectile arranged in front of the annular space. Such an annular space, formed in combination with the subcaliber projectile, has the advantage over a gas pressure chamber constructed, for example, in the hood in the form of several longitudinal channels arranged at a spacing from the subcaliber projectile and being closed at the front ends, that with the same external hood size and the same hood strength, the gas pressure chamber can be fashioned with a larger volume with a correspondingly increased attenuation effect, and that also a larger cross-sectional area of the hood, on which the propellant gases are effective, is attainable thereby.

The hood can be provided in a conventional manner on its outside with cutouts, notches, or the like extending in the longitudinal direction, for example in order to reduce the mass of the hood or also to facilitate a possible fragmentation of the hood after its separation. In addition thereto or also in place thereof, it is possible in accordance with a feature of the present invention to uniformly arrange internal indentations, grooves, pockets, recesses, or the like emanating from the annular space and extending in the longitudinal direction up into the guiding portion. These additional longitudinally extending recesses, which extend the annular space in the forward direction, can be formed, for example, as bores of the blind hole type or as pockets, which do not interrupt the internal jacket surface of the hood in the zone of the guiding portion. However, preferably, these recesses are fashioned as longitudinal grooves, notches, slots, or the like, which interrupt the contact surface of the hood in the guiding portion so that the hood contacts the projectile with the interposed ridges, ribs, or the like, thus centering the projectile. Thereby, a further increase of the volume of the gas pressure chamber and a reduction of the mass of the hood can be advantageously achieved. Another advantage resides in the increase of the amount of propellant gas which has entered the hood and is, so to speak, stored therein, since these propellant gases, after the hood has exited from the mouth of the barrel, flow off toward the rear and thus effect an additional acceleration of the hood, which increases the spacing of the hood from the subcaliber projectile even further. These effects are additionally intensified by providing that the grooves, notches, slots or the like terminate with their forward ends into a common hollow space arranged in front of the projectile.

The sabot being of caliber size and preferably being made of a light metal, e.g. an aluminum alloy, exhibits at least one longitudinally extending bore, by way of which the propellant gases can flow to the side facing the hood. This at least one bore or gas duct can be formed in a great variety of ways from a constructional viewpoint. For example, in accordance with preferable constructions, at least two eccentric gas ducts are uniformly distributed over the cross section or a central, axial, gas duct is provided whereby the propellant gases exiting therefrom flow laterally around the rear of the projectile and are effective on the hood. In the eccentric arrangement of the gas ducts, the outlet opening on the hood side is preferably disposed laterally beside the subcaliber projectile, so that no special measures are required for conducting the propellant gases around the rear of the subcaliber projectile. The gas ducts need not absolutely be arranged to be parallel in the axial or longitudinal direction, but rather can also extend obliquely to the longitudinal axis of the sabot. In the central gas duct arrangement, which can also be provided in addition to the eccentric gas ducts, the outlet opening lies underneath the rearward end face of the subcaliber projectile so that in such arrangement, unless the end face of the projectile is arranged at a spacing from the surface of the sabot facing the end face, additional lateral, i.e., radial and optionally also longitudinal exhaust ducts must be provided to guide the propellant gases past the rear of the projectile. For this purpose, the rear of the projectile can be equipped, for example, with crosswise arranged grooves. The central gas duct furthermore affords the possibility to attain the effect, in case of an appropriate mass distribution, that also the subcaliber projectile is accelerated relatively to the sabot and thus is separated from the latter while still in the barrel of the gun.

The sabot projectile according to the present invention can be fired from smooth or rifled barrels. In order to transmit, in rifled barrels, the twist to the subcaliber projectile, it is possible to conventionally provide a plug-in connection between the sabot and the subcaliber projectile, for example in the form of several radial pins arranged in the sabot, which engage into rearwardly open slots of the subcaliber projectile, so that there is a locking action in the peripheral direction, while there is no such action in the axial direction. In other words, the separation of the sabot from the subcaliber projectile after firing is not impeded. The expenditure for such an additional plug-in connection can be eliminated if, the hood is connected to the subcaliber projectile so that its spin motion is transmitted to the subcaliber projectile. The rotationally fixed connection required for this purpose can be attained, for example, by a frictional lock in that the hood contacts the subcaliber projectile with a sufficiently firm press-fit. As a result, the torque can be transmitted to the subcaliber projectile, on the one hand, while the hood can be pulled away from the projectile, on the other hand, under the action of the propellant gases. Both types of spin transmission to the subcaliber projectile can, however, also be utilized in combination.

It has proven to be advantageous, for spin transmission by way of the hood, to provide the hood with at least one gas pressure chamber constructed, in particular, as an annular space surrounding the subcaliber projectile. Insofar as the hood is produced from a sufficiently expansible material, for example a thermoplastic synthetic resin, the hood is radially expanded by the propellant gases flowing into the hood and, by this expansion, is pressed into the riflings of the barrel in such a way that the spin is transmitted by the barrel not only to the sabot, but also directly to the hood. Depending on the individual circumstances, it is thus possible to make do without a spin transmission by way of the sabot to the hood, if desired. The direct spin transmission from the barrel to the hood is furthermore promoted by providing the hood with internal longitudinal cutouts, notches, pockets, or the like in accordance with the invention, rather than with external longitudinal cutouts, notches, or the like. This, on the one hand, makes the entire external, cylindrical wall surface of the hood, which is not interrupted by any indentations, available for the spin transmission whereas, on the other hand, the additional internal, longitudinal recesses enhance the expansion action.

A particularly advantageous connection between the hood and the subcaliber projectile can be provided by providing the subcaliber projectile with a noncircular cross section along a part of its length with the hood contacting the projectile thereat. This connection, which is form-fitting in the peripheral direction and fixed against rotation, can be attained, for example, by fashioning the projectile along a part of its length with a polygonal, for example rectangular, cross section.

In accordance with another feature of the present invention, the subcaliber projectile can be provided with wings arranged to be uniformly distributed along its circumference in the rear zone thereof, to attain the required stabilization in case of a spin-free projectile. The wings can optionally also be slightly inclined in a conventional manner so that, due to the air flow against the wings, which are slightly inclined in the flying direction, the subcaliber projectile is set into rotation and thus is stabilized. Further, the wings can be extended into an annular space at the rear of the hood. If the wings are provided in a projectile fired from a rifled barrel, these wings can be utilized in place of additional, radial locking elements to lock the sabot and the subcaliber projectile together, for the purpose of spin transmission, in the peripheral direction.

If there is the possibility, in case of a relatively late separation of the hood, that there may be a collision between the hood and the subcaliber projectile after exiting from the barrel, it is advantageous to construct the hood with a cross section which is non-rotationally symmetric so that it is laterally deflected from the flight path of the subcaliber projectile in that the hood assumes a substantially more curved trajectory. For this purpose, it is possible to provide the hood, for example, with one or more asymmetrically arranged longitudinal notches in the zone of its front end.

The subcaliber projectile of the sabot projectile of this invention can be constructed in a variety of different ways, for example as a hardcore projectile from a material of high density or as a bursting projectile. However, it is also possible, for example, to combine several component projectiles with still smaller radial dimensions into a bundle to form the subcaliber projectile, in order to attain in the target a large-area effect due to the component projectiles which impinge at different points. The subcaliber projectile, however, can also be fashioned as a training projectile the range of which, with a correspondingly smaller mass, is shorter than that of an original projectile having the full caliber. In this connection, there is the possibility of adapting the reduction in the maximum firing range and also the course of the trajectory, for example, to the respective requirements, depending on the proportion of the mass of the subcaliber projectile to its diameter as compared to these values as they exist in the original projectile. An increased braking action and thus a reduction of the maximum firing range is possible in this short-range ammunition by increasing the aerodynamic drag of the subcaliber projectile. This can be done by constructing the projectile, for example, with a forward end face at right angles to its longitudinal axis. Also the optionally provided wings can be designed, in a spin-stabilized subcaliber projectile, so that they diminish the rotation of the projectile in the intended practice range to such an extent that the number of revolutions critical for a stable flight is exceeded in the downward direction at the end of the training range, the subcaliber projectile then becoming unstable and continuing its flight under increased drag and with an accordingly shortened flight range. Preferably, this practice ammunition is utilized for calibers of about 20 mm. and larger.

These and other objects, features and advantages of the present invention will become more apparent from the following description when taken in connection with the accompanying drawings, which show, for purposes of illustration only, several embodiments in accordance with the present invention.

Figure 1B:
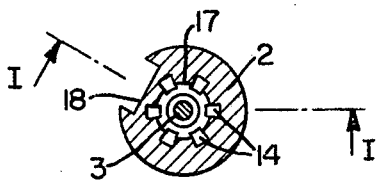
Figure 1C:
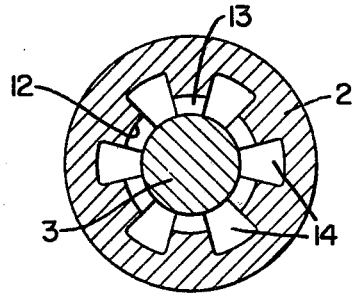
Figure 1D:
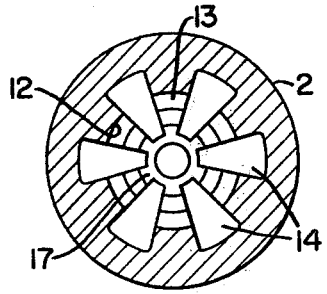
Figure 1F:
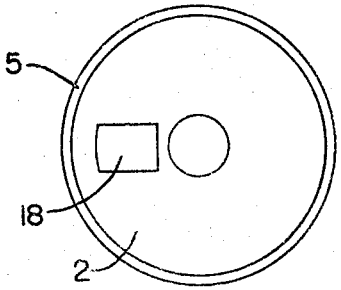
Figure 2A:
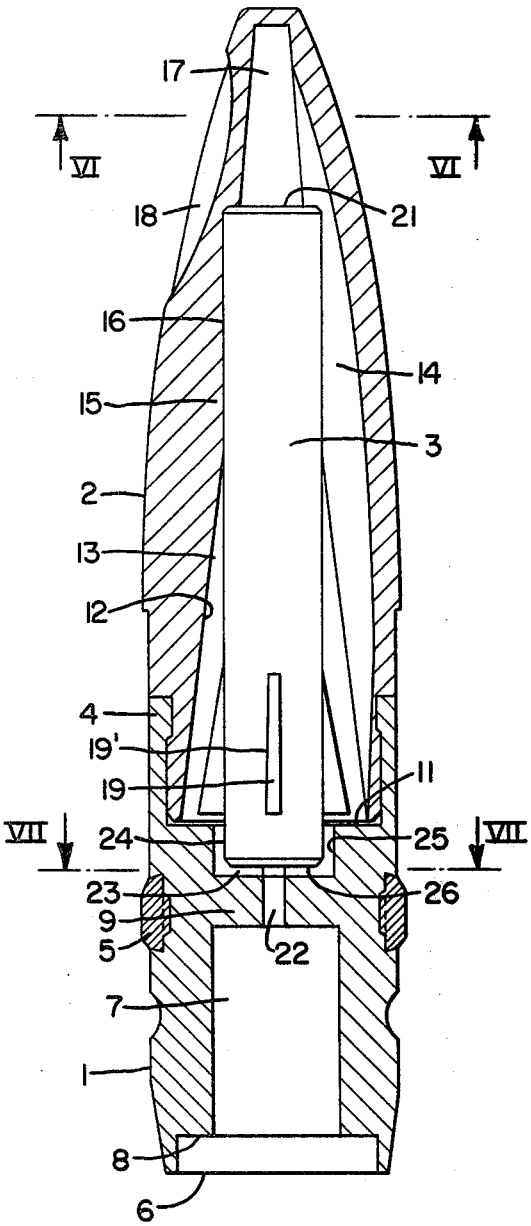
Figure 2B:
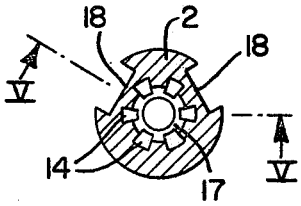
Figure 2C:
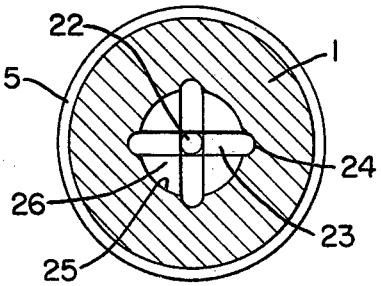
Figure 2D:
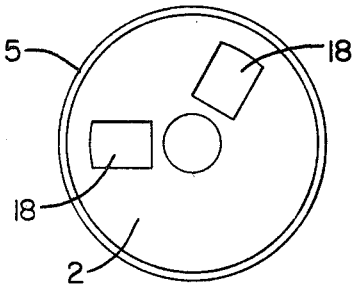
Figure 3A:
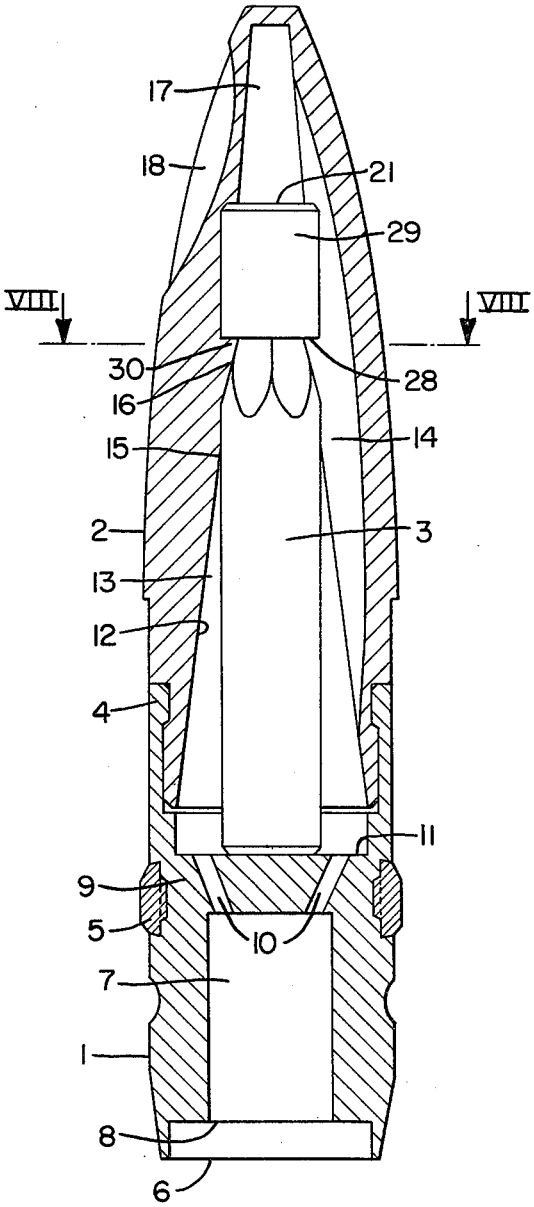
Figure 4A:
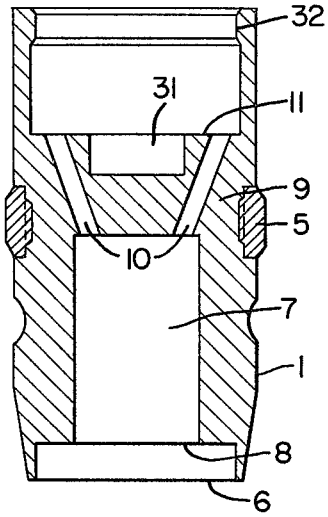
Figure 4B:
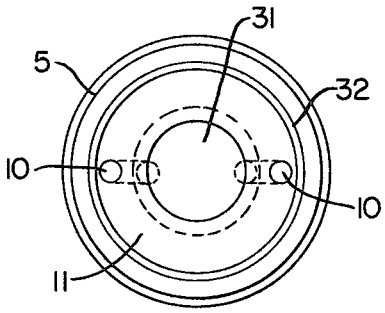
Figure 3B:
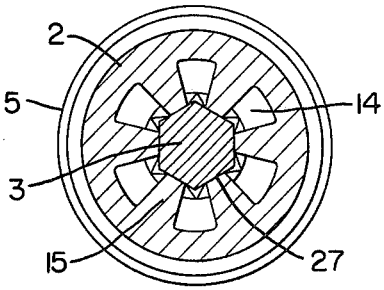

FIG. 1*a* is a longitudinal sectional view of a sabot projectile in accordance with the present invention, FIGS. 1*b* through 1*e* show various cross sections relating to FIG. 1*a*, and FIG. 1*f* is a top end view of the sabot projectile of FIG. 1*a*;

FIG. 2*a* is a longitudinal sectional view of a sabot projectile with a subcaliber projectile having a shortened range, FIGS. 2*b* through 2*d* illustrate two different cross sections and a top end view respectively of the FIG. 2*a* embodiment;

FIGS. 3*a* and 3*b* illustrate a sabot projectile with a form-fitting connection between the hood and the subcaliber projectile in a longitudinal section and a cross section respectively; and FIGS. 4*a* and 4*b* illustrate a sabot in a longitudinal sectional view and in a top end view respectively.

Figure 1E:
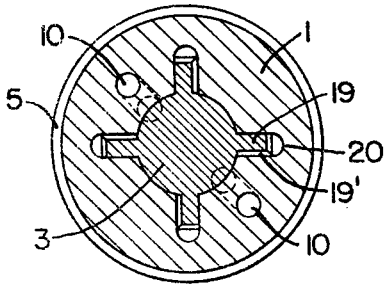

Referring now to the drawings wherein like reference numerals designate like parts throughout the several views, FIG. 1*a* represents a longitudinal section along line I—I of FIG. 1*b* of a sabot projectile in accordance with the present invention wherein the sabot 1 is formed, for example, of an aluminum alloy, and the hood 2 is formed, for example, of polyethylene, and are illustrated in a longitudinal sectional view, while the subcaliber projectile 3 which is constructed, for example, as a hardcore projectile, is shown in a plan view. The sabot 1 is connected to the hood 2 by way of a snap connection 4, in that it engages with an annular bead into a corresponding annular groove of the hood 2. The sabot 1 is provided with a guide strip 5, and is also provided with cylindrical depression or recess 7 having a shoulder 8 which recess emanates from the rearward end face 6 of the sabot, this recess being limited in the forward direction by the bottom 9. Two eccentrically arranged longitudinally extending gas ducts 10 are provided in the bottom 9, these ducts opposing each other radially and being inclined toward the outside in the forward direction, so that they exit, on the side 11 of the bottom 9 of the sabot 1 facing the hood 2 laterally beside the subcaliber projectile 3. Since the gas ducts 10 according to FIG. 1*e* are not in the plane of the drawing, they are merely indicated in dashed lines. The gas ducts 10, which are also denoted as external nozzles on the basis of their geometrical arrangement and their function with regard to the control of the amounts of propellant gases entering the hood 2, connect the depression 7 and thus the rearward face of the sabot 1 which can be exposed to the propellant gases with a gas pressure chamber 12 of the hood 2.

The gas pressure chamber 12 is constructed as a central recess in the hood 2 which narrows conically in the forward direction, this recess constituting the annular space 13 together with the subcaliber projectile 3. Emanating from the annular space 13, inner longitudinal grooves 14 extend in the forward direction, the grooves being uniformly distributed over the cross section of the hood 2. Respectively, one bridge or rib 15 is formed between each two adjacent grooves 14, the bridge contacting the subcaliber projectile 3 in the zone of a guiding portion 16, so that the projectile is radially supported and thus centered. Furthermore, a common hollow space 17 is formed in the tip of the hood 2, which connects all grooves 14 with one another. An external notch 18 is provided in the forward zone of the hood 2, so that the hood is non-rotationally symmetric, whereby it is deflected, after exiting from the barrel of the gun, laterally from the flight path of the subcaliber projectile 3.

The subacliber projectile 3 is placed with its rear end in a cylindrical depression of the bottom 9 of the sabot 1, and is thereby additionally guided in the subcaliber direction. Four wings 19 of the projectile 3 extend into corresponding radial slots 20 of the bottom 9 so that the sabot 1 and the projectile 3 are joined together for rotation with each other, in order to provide spin transmission. One of the lateral surfaces 19' of the wings 19 is slightly inclined with respect to the longitudinal axis. The left-hand radial slot 20 is illustrated in accordance with the section I—I in FIG. 1*b* and the representation in FIG. 1*e* so that it is pivoted by 30°.

FIGS. 1*b* is a cross section along line II—II in FIG. 1*a*, whereas FIGS. 1*c* and 1*d* show cross sections along line III—III in FIG. 1*a*, FIG. 1*d* being shown without the projectile 3. FIG. 1*e* is a cross section along line IV—IV in FIG. 1*a*, clearly illustrating the radial slots 20 fashioned in the sabot 1 for receiving the wings 19 with the inclined lateral surface 19' of the projectile 3, as well as the two gas ducts 10. FIG. 1*f* shows the sabot projectile in a top end plan view, wherein the notch 18 in the hood 2 is illustrated so that it is pivoted by 30° as compared to FIG. 1*b*.

In the sabot projectile according to FIG. 2*a*, representing a partial longitudinal section along line V—V in FIG. 2*b*, the subcaliber projectile 3, made, for example, of steel or of an aluminum alloy, has a vertical forward end face 21 to shorten, for training purposes, the maximum firing range of this projectile by increasing the aerodynamic drag. The at least one longitudinal recess of the sabot 1, permitting the flow of the propellant gases against the hood 2, is in this embodiment constructed as a central axial gas duct 22. On the side of the hood, in order to conduct the propellant gases around the rear of the projectile 3, this central duct or nozzle 22 is followed by radial exhaust ducts 23 and longitudinal exhaust ducts 24, from which the propellant gases then can enter the annular space 13 of the hood 2. The projectile 3 is guided with its rear in a recess of the sabot 1 and rests on a wall 25 and bottom 26 thereof. Insofar as a spin transmission to the projectile 3 is intended, such transmission can be accomplished, for example, by way of the bridges 15 of the hood 2 contacting the projectile 3 with a press-fit in the zone of the guiding portion 16.

FIGS. 2*b* and 2*c* are cross sections along lines VI—VI and VII—VII of FIG. 2*a*. In the top end view according to FIG. 2*d*, the two outer notches 18 are illustrated to be offset by 30° as compared to FIG. 2*b*.

The sabot projectile of FIG. 3*a* shows a subcaliber projectile 3 without wings, fashioned in the zone of the guiding portion 16 along part of its length with a polygonal cross section, in this embodiment with a regular hexagonal shape, wherein the bridges 15 of FIG. 3*b*—which is a cross section along line VIII—VIII of FIG. 3*a*—rest on the lateral surfaces 27 of the hexagonal section and thus result in a connection between the hood 2 and the projectile 3 which is form-fitting in the peripheral direction. In the forward direction, a circular-cylindrical part 29, with a shoulder 28, follows the hexagonal portion, the diameter of the part 29 being equal to that of the remaining, circular-cylindrical body of the projectile. During assembly, the hood 2 is expanded elastically to a minor extent when the projectile 3 is pressed into place, until the bridge lugs 30 thereof snap inwardly behind the shoulder 28. Thus, the projectile 3 is fixed by a form-fitting action advantageously also in the longitudinal direction. Both form-fitting connections can be eliminated during firing at a predetermined propellant gas pressure. The groove 14 in FIG. 3*a* is shown pivoted by 30° into the plane of the drawing, as compared to FIG. 3*b*.

In FIGS. 4*a* and 4*b*, another modification of the sabot 1 is illustrated. The sabot is provided with two gas ducts 10 constructed as external nozzles as well as being provided with an indentation 31 for the additional centering of the rear of the projectile which is not shown. An annular bead 32 is provided for the form-fitting connection with the elastically deformable hood which also is not shown in the drawing.

While we have shown and described only several embodiments in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

We claim:

1. A sabot projectile comprising a subcaliber projectile, a sabot having at least one longitudinally extending bore means arranged for exposure to propellant gases upon firing of the sabot projectile from a barrel of a weapon, and a hood means arranged in front of the sabot and surrounding at least a portion of the subcaliber projectile, the hood means being coupled at least to one of the sabot and the subcaliber projectile and being separable therefrom, the bore means being arranged for directing the propellant gases onto the hood means for accelerating the hood means relative to at least one of the sabot and subcaliber projectile while the sabot projectile is within the barrel of the weapon. sabot

2. A sabot projectile according to claim 1, wherein the hood means surrounds the subcaliber projectile along at least a portion of the length thereof and the acceleration of the hood means relative to at least one of the sabot and subcaliber projectile within the barrel of the weapon enables the decoupling of the hood means from the at least one of the sebot and subcaliber projectile.

3. A sabot projectile according to claim 1, wherein the hood means includes at least one gas pressure chamber means for receiving propellant gases flowing through the longitudinal bore means upon firing of the sabot projectile.

4. A sabot projectile according to claim 3, wherein the hood means contacts the subcaliber projectile along at least a portion of the length thereof and includes guiding means in the region of contact with the subcaliber projectile, the gas pressure chamber means being delimited by an annular space emanating from the rear end of the hood means and surrounding at least a portion of the length of the subcaliber projectile, the guiding means being arranged subsequent to the annular space in the forward direction.

5. A sabot projectile according to claim 4, wherein the hood means includes a plurality of internal longitudinally extending recess means uniformly distributed over the cross section thereof and extending in the forward direction from the annular space into at least the guiding means of the hood means.

6. A sabot projectile according to claim 5, wherein the hood means includes a hollow space at the front portion thereof, the longitudinally extending recess means terminating at the hollow space which forms a common hollow space for the terminating forward ends of the recess means.

7. A sabot projectile according to claim 6, wherein the hollow space of the hood means is arranged in front of the subcaliber projectile.

8. A sabot projectile according to claim 1, wherein the longitudinal bore means of the sabot includes at least two eccentrically arranged gas ducts uniformly distributed over the cross section of the sabot.

9. A sabot projectile according to claim 8, wherein the longitudinal bore means further includes an axial recess in the sabot emanating from the rear end thereof, the at least two gas ducts extending from the recess.

10. A sabot projectile according to claim 1, wherein the longitudinal extending bore means includes a central gas duct arranged with respect to the rear of the subcaliber projectile such that the propellant gases exiting from the central gas duct flow laterally around the rear of the subcaliber projectile before becoming effective on the hood means.

11. A sabot projectile according to claim 10, wherein the longitudinal bore means of the sabot includes an axial recess emanating from the rear of the sabot, the central gas duct extending from the recess.

12. A sabot projectile according to claim 1, wherein the hood means includes coupling means for coupling the hood means with the subcaliber projectile for enabling the spin motion of the hood means to be transmitted to the subcaliber projectile.

13. A sabot projectile according to claim 12, wherein the subcaliber projectile is provided along a portion of its length with a non-circular cross section, the coupling means of the hood means contacting the subcaliber projectile at least in the region of the non-circular cross section of the subcaliber projectile.

14. A sabot projectile according to claim 1, wherein the subcaliber projectile is provided in the rear zone thereof with wing members uniformly distributed over the circumference thereof.

15. A sabot projectile according to claim 14, wherein the hood means includes an annular space at the rear portion thereof, the wing members of the subcaliber projectile being inclined in the flight direction and extending into the annular space.

16. A sabot projectile according to claim 15, wherein the sabot includes recesses into which the wings of the subcaliber projectile extend.

17. A sabot projectile according to claim 1, wherein the hood means includes an outer nonrotationally symmetric cross-sectional configuration.

18. A sabot projectile according to claim 1, wherein the subcaliber projectile is a training projectile having a shortened range.

19. A sabot projectile according to claim 16, wherein the subcaliber projectile is provided with a flattened forward portion for providing increased drag resistance during flight and a shortened range of the subcaliber projectile.

20. A sabot projectile according to claim 7, wherein the hood means surrounds the subcaliber projectile along at least a portion of the length thereof and the acceleration of the hood means relative to at least one of the sabot and subcaliber projectile within the barrel of the weapon enables the decoupling of the hood means from the at least one of the sabot and subcaliber projectile.

21. A sabot projectile according to claim 20, wherein the hood means includes an outer nonrotationally symmetric cross-sectional configuration.

22. A sabot projectile according to claim 20, wherein the longitudinal bore means of the sabot includes at least two eccentrically arranged gas ducts uniformly distributed over the cross section of the sabot.

23. A sabot projectile according to claim 22, wherein the longitudinal bore means further includes an axial recess in the sabot emanating from the rear end thereof, the at least two gas ducts extending from the recess.

24. A sabot projectile according to claim 23, wherein the subcaliber projectile is provided in the rear zone thereof with wing members uniformally distributed over the circumference thereof

25. A sabot projectile according to claim 24, wherein the hood means includes coupling means for coupling the hood means with the subcaliber projectile for enabling the spin motion of the hood means to be transmitted to the subcaliber projectile.

26. A sabot projectile according to claim 25, wherein the subcaliber projectile is provided along a portion of its length with a non-circular cross section, the coupling means of the hood means contacting the subcaliber projectile at least in the region of the non-circular cross section of the subcaliber projectile.

27. A sabot projectile according to claim 24, wherein the hood means includes an outer nonrotationally symmetric cross-sectional configuration.

28. A sabot projectile according to claim 27, wherein the subcaliber projectile is a training projectile having a shortened range.

29. A sabot projectile according to claim 20, wherein the longitudinal extending bore means includes a central gas duct arranged with respect to the rear of the subcaliber projectile such that the propellant gases exiting from the central gas duct flow laterally around the rear of the subcaliber projectile before becoming effective on the hood means.

30. A sabot projectile according to claim 29, wherein the longitudinal bore means of the sabot includes an axial recess emanating from the rear of the sabot, the central gas duct extending from the recess.

31. A sabot projectile according to claim 30, wherein the subcaliber projectile is provided in the rear zone thereof with wing members uniformly distributed over the circumference thereof.

32. A sabot projectile according to claim 31, wherein the hood means includes coupling means for coupling the hood means with the subcaliber projectile for enabling the spin motion of the hood means to be transmitted to the subcaliber projectile.

33. A sabot provided according to claim 32, wherein the subcaliber projectile is provded along a portion of its length with a non-circular cross section, the coupling means of the hood means contacting the subcaliber projectile at least in the region of the non-circular cross section of the subcaliber projectile.

34. A sabot projectile according to claim 31, wherein the hood means includes an outer nonrotationally symmetric cross-sectional configuration.

35. A sabot projectile according to claim 34, wherein the subcaliber projectile is a training projectile having a shortened range.

* * * * *